US006171021B1

(12) United States Patent
Feldtmann

(10) Patent No.: US 6,171,021 B1
(45) Date of Patent: Jan. 9, 2001

(54) METHOD AND APPARATUS FOR REDUCING THE WAKE WASH OF VESSELS IN SHALLOW WATERS

(76) Inventor: Mats H. Feldtmann, 701 NE. 16th Ave., #4, Fort Lauderdale, FL (US) 33304

( * ) Notice: Under 35 U.S.C. 154(b), the term of this patent shall be extended for 0 days.

(21) Appl. No.: 09/163,209

(22) Filed: Sep. 29, 1998

(51) Int. Cl.[7] ..... E02B 3/04
(52) U.S. Cl. ..... 405/15; 405/303; 37/195
(58) Field of Search ..... 405/15, 73, 74, 405/16, 21, 23, 25, 303; 37/307, 308, 313, 195

(56) References Cited

U.S. PATENT DOCUMENTS 1,314,743 * 9/1919 Groat ..... 405/25
3,750,408 * 8/1973 Den Hartog ..... 37/195
3,841,710 * 10/1974 Boland et al. ..... 405/73
4,374,420 * 2/1983 Wolters ..... 37/308
4,943,186 * 7/1990 Van Weezenbeek ..... 405/73

FOREIGN PATENT DOCUMENTS

228336 * 5/1960 (AU) ..... 405/25

* cited by examiner

*Primary Examiner*—Eileen D. Lillis
*Assistant Examiner*—Frederick L. Lagman
(74) *Attorney, Agent, or Firm*—Holland & Knight LLP

(57) ABSTRACT

A method and apparatus involving forming a transition area along the bed of a body of water in which the natural water depth is altered, and operating a vessel in the course of passage through the transition area such that the vessel speed instantaneously changes from supercritical speed to subcritical speed while substantially avoiding the critical speed range.

35 Claims, 3 Drawing Sheets

METHOD AND APPARATUS FOR REDUCING THE WAKE WASH OF VESSELS IN SHALLOW WATERS

FIELD OF THE INVENTION

This invention relates to the operation of high-speed vessels in shallow waters, and, more specifically, to a method and apparatus for reducing wake wash produced by high-speed vessels in the course passage through shallow waters in bodies of water such as harbors, rivers, canals and the like.

BACKGROUND OF THE INVENTION

High speed vessels, including military craft, ferries and pleasure boats, are steadily increasing in number in many areas of the world. The development of water jets and light weight construction methods has made it both possible and economical to transport people and goods on the water at increasingly higher speeds. Unfortunately, such higher speeds have also created problems with wake wash in relatively shallow waters near the shoreline such as in harbors, rivers, canals and other estuaries.

Studies have been conducted to determine the effects of running a vessel in shallow waters. One important parameter is known as the depth Froude number, which is a function of vessel speed, the water depth and gravitational acceleration. It has been found that a depth Froude number of unity corresponds to the maximum speed at which free harmonic water waves can travel undisturbed on the surface of a body of water. Vessels operated at a speed in shallow waters which produces a depth Froude number of about unity develop moderate size waves which can travel long distances at high energy. As these high energy waves approach a shoreline, where the water depth continues to decrease, the wave periods become shorter causing the wave height to increase. In turn, these larger waves can be hazardous to other users of the body of water and can severely damage the environment and/or man-made structures along the shoreline.

The speed at which a vessel produces a depth Froude number of unity, for a given shallow water area such as a harbor, river or canal, is known as the critical speed. Modern high speed vessels are operated at subcritical speeds in deep waters, but once entering shallow waters the same vessel speed over ground can be critical or supercritical. The problem of excessive wake wash mainly occurs when a high speed vessel transitions between supercritical speed and subcritical speed in the course of passing through a shallow water area. For example, a high speed ferry must decelerate from supercritical speed to subcritical speed in the course of entering a harbor to unload passengers, and then accelerate from subcritical speed to supercritical speed on the return trip. The longer it takes for the ferry to accomplish these transitions, the more wake wash is created, fuel is wasted and time is lost.

Another problem associated with transitioning between subcritical speed and supercritical speed, particularly for slower vessels, results from the increase in wave making as the vessel approaches critical speed. The larger waves formed by the vessel near the critical speed act, in effect, as a barrier and resist acceleration of the vessel which slows it down. Consequently, additional fuel and energy area required to overcome this wave resistance in the course of accelerating the vessel from subcritical speed through critical speed to supercritical speed.

The problems with vessel operation and unacceptable wake wash noted above have been investigated, but no viable solutions have been proposed. Although a vessel can be operated at reduced, subcritical speed before reaching shallow waters, this substantially increases transport time and can waste fuel. Additionally, while breakwaters have been employed in some areas to reduce the effects of wake wash, this is expensive and often cannot be employed in smaller bodies of water such as river, canals or other estuaries.

SUMMARY OF THE INVENTION

It is therefore among the objectives of this invention to provide a method and apparatus for reducing wake wash in shallow water areas which avoids operation of high speed vessels at the critical speed, which permits a transition directly from supercritical speed to subcritical speed, which is effective in virtually all types of shallow water areas, which preserves the shoreline and which increases the economies of high speed vessel operation.

These objectives are accomplished in a method and apparatus involving forming a transition area along the bed of a body of water in which the natural water depth is altered, and operating a vessel in the course of passage over the transition area such that the vessel speed instantaneously changes from supercritical speed to subcritical speed without passing through critical speed.

One aspect of this invention is predicated upon the concept of changing the configuration of the bed in a discrete area of shallow waters within a body of water over which vessels can be decelerated and accelerated without passing through the critical speed. In one presently preferred embodiment, the transition area is in the form of a dredged pit having a bottom wall, opposed side walls and opposed end walls collectively defining an interior having a depth greater than the normal or natural depth of the water at that location. The length of the dredged pit, or distance between the opposed end walls, is preferably about two to five vessel lengths. The distance between the two side walls, or width of the pit, is preferably on the order of about one to five times that portion of the width of the vessel which is submerged in the water.

In an alternative embodiment, the transition area comprises a ramp having a first end, a second end spaced from the first end, a top wall extending between the first and second ends and opposed side walls located on either side of the top wall. The ramp has a height dimension, measured from the bed of the body of water in an upward direction, which increases from the first end to the second end at which the water level is less than the natural depth of the body of water. The length and width dimension of the ramp of this embodiment are substantially the same as the area of the interior of the dredged pit described above.

In a still further embodiment, the transition area is formed from a combination of the ramp and dredged pit discussed above. Preferably, a ramp and dredged pit are located immediately adjacent one another with a combined length in the range of about two to five vessel lengths or more, and an overall width in the range of about one to five times the width of that portion of the vessel which is submerged in the water.

It is contemplated that the transition area utilized in a particular location will be dependent upon the configuration of the existing bed of the body of water, with a view toward minimizing the amount of construction required to build the transition area. Regardless of the type of transition area employed, an important aspect of this invention involves operating a particular vessel in such a way as to "skip" or transition between supercritical speed and subcritical speed in the course of passage over the transition area, without passing through critical speed. In the presently preferred embodiment, the vessel speed is controlled to decelerate from a depth Froude number of about 1.4 to a depth Froude number of about 0.8 as the vessel passes over the transition area. Conversely, when accelerating the vessel, the speed over the transition area is increased to transition from a depth Froude number of about 0.8 to about 1.4. As noted above, and described in detail below, such vessel speeds are a function of gravitational acceleration and the water depth of a particular body of water in the region of the transition area. In practice, the location of a transition area within the shallow waters of a body of water will be marked with buoys or the like, and operators of vessels will be assigned specific speeds to be observed upon entering and leaving the transition area depending upon tidal conditions. By avoiding the critical speed in areas close to the shoreline, damage to the environment and man-made structures caused by wake wash is substantially reduced.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1A:
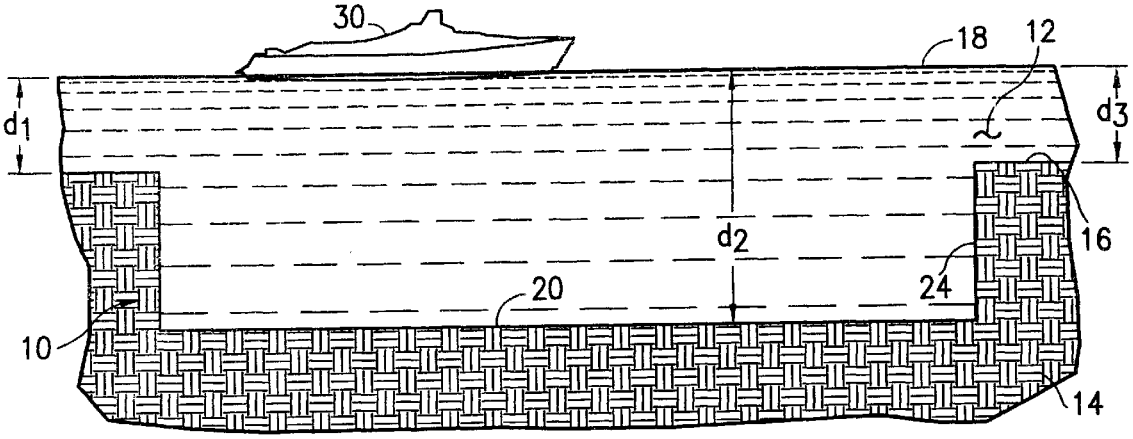
FIG. 1A is an elevational view, in partial cross section, of one embodiment of the transition area of this invention.
Figure 1B:
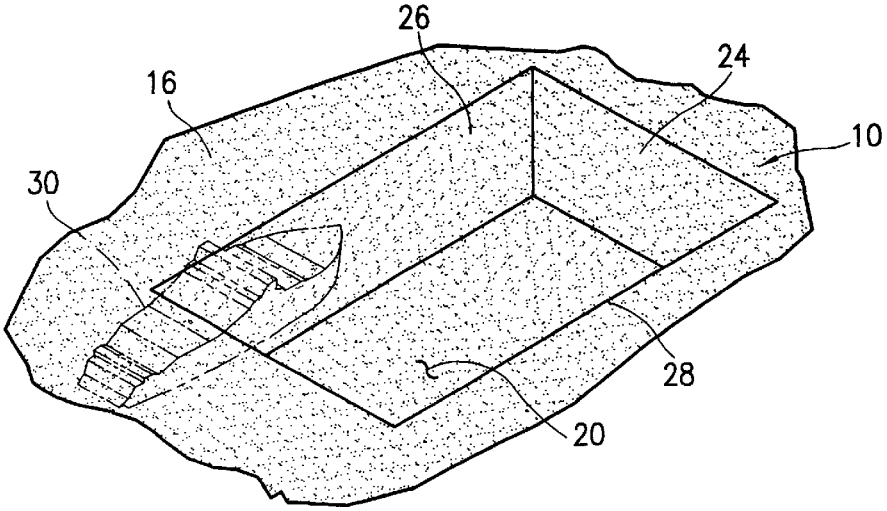
FIG. 1B is a perspective view of the transition area depicted in FIG. 1A.
Figure 1C:
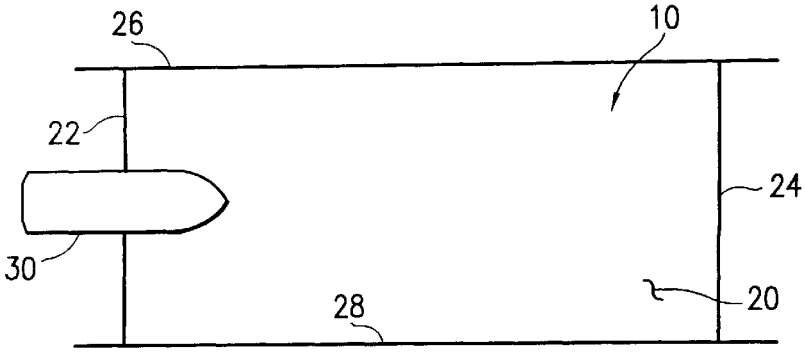
FIG. 1C is a schematic, plan view of the transition area of FIGS. 1A and 1B.

Referring initially to FIGS. 1A–1C, one embodiment of a transition area 10 employed in the method of this invention is schematically depicted. For purposes of the present discussion, a body of water 12 is illustrated, such as a harbor, river or canal, having a bed 14. The term "natural water depth" as used herein is meant to refer to the greatest distance between the top 16 of the bed 14 and the surface 18 of the body of water 12, e.g., at high tide conditions, where applicable. The natural water depth is also identified with reference to particular vertical distances as described below in connection with a discussion of the embodiment in FIGS. 1A–1C, as well as the alternative embodiments shown in FIGS. 2A–3C.

In one presently preferred embodiment, the transition area 10 is essentially a dredged pit having a bottom wall 20, opposed end walls 22 and 24, and, opposed side walls 26 and 28 . The length of transition area 10, defined by the distance between the end walls 22,24, is on the order of about two to five lengths of the vessel 30. The width of transition area 10 is defined by the distance between the two sidewalls 26,28, which is preferably in the range of about one to five times the width of that portion of the vessel 30 which is submerged in the water. It is contemplated that the transition area 10 will be formed by a dredging operation, producing end walls 22, 24 generally parallel to one another and perpendicular to the bottom wall 20. The same is true for side walls 26, 28, although all of the walls 22–28 could be oriented at angles somewhat greater than or less than perpendicular with respect to the bottom wall 20, and be considered within the scope of this invention. Depending upon the characteristics of the bed 14 underlying the body of water 12, the walls 22–28 may be reinforced with steel beam, wooden piles or any other suitable means.

The length and width dimensions of the transition area 10, in relation to each other and compared to the dimensions of vessel 30, are roughly and schematically depicted in FIGS. 1A–1C. For ease of illustration, more exact relative dimensions are not shown. With respect to the references noted above to the length and width dimensions of vessel 30, it is contemplated that a variety of different high-speed vessels could be accommodated by the transition area 10 of this invention and still obtain the benefits of reduced wake wash described herein at least to some extent. It is recognized that vessels such as ferries, military vessels and pleasure boats can vary substantially in length and width dimensions. As such, when a reference is made to vessel dimensions in the discussion of this embodiment, and the description of the embodiments depicted in FIGS. 2A–3C, it should be understood that in practice the vessel length and width would be chosen for a specific installation of a transition area depending upon the dimensions of the craft(s) which typically create the worst wake wash conditions.

As noted above, maximum wake wash is produced at depth Froude numbers approaching unity by vessels operating near "critical speed". For purposes of the present discussion, the term "critical speed" therefore refers to vessel speeds producing a depth Froude number near unity for a given water depth. In turn, "supercritical speed" refers to vessel speeds producing a depth Froude number in excess of unity for that water depth, whereas a vessel operating at "subcritical speed" produces a depth Froude number for such water depth which is less than unity. It is a primary objective of this invention to effectively by-pass critical speed, i.e. transition directly from supercritical speed to subcritical speed and vice versa, in the course of passage of the vessel 30 over transition area 10, and the alternative embodiments of transition areas 40 and 60 described below.

The design details of transition area 10 which achieve this objective, in combination with certain required operational parameters of vessel 30, are derived from the following. Initially, the depth Froude number, $Fn_d$, is given by the relationship:

$$Fn_d = \frac{V}{(gd)^{0.5}} \tag{1}$$

where:

V=vessel velocity (meters/sec)

g=gravitational constant (meters/sec$^2$)

d=natural water depth (meters)

It can be seen that the relationship between vessel velocity and water depth determines the depth Froude number.

In the presently preferred embodiment, for the majority of shallow water areas within bodies of water such as harbors, rivers, canals and other estuaries, the transition area 10 can be constructed to allow a vessel 30 to achieve a substantially instantaneous transition between a supercritical speed which results in a depth Froude number of about 1.4, and a subcritical speed which results in a depth Froude number of about 0.8. That "jump" or transition avoids critical speed of the vessel 30 and therefore substantially eliminates excessive wake wash on the adjacent shoreline. The velocity parameters of the vessel 30, and physical dimensions of the transition area 10, are determined as follows.

Initially, the vessel 30 is slowed as it approaches the transition area from its deep water, high speed velocity to a supercritical speed, $V_1$, producing a depth Froude number of about 1.4. This is expressed in the following relationship:

$$V_1=Fn_d(gd_1)^{0.5}$$

$$V_1=1.4(gd_1)^{0.5} \quad (2)$$

Where:

$V_1$=vessel velocity approaching the transition area (meters/sec)

g=gravitational acceleration (meters/sec$^2$)

$d_1$=natural water depth of body of water (meters)

As noted above, the intent is to obtain an essentially instantaneous transition between a depth Froude number of about 1.4 and a depth Froude number of about 0.8, without passing through a depth Froude number of about unity. In order to avoid critical speed when the vessel 30 is outside of the transition area 10, the velocity, $V_1$, of the vessel 30 must be at least initially constant as the vessel 30 enters the transition area 10. As such, the initial velocity within the transition zone 10, $V_2$, must equal the Velocity $V_1$.

$$V_1=V_2 \quad (3)$$

Where:

$V_1$=supercritical vessel velocity approaching the transition area 10 (meters/sec)

$V_2$=initial vessel velocity within the transition area (meters/sec)

At the same time, the construction of the transition area 10 must be such as to create a depth Froude number of about 0.8. In other words, at constant vessel velocity the transition area 10 is constructed to obtain an instantaneous jump or transition between a depth Froude number of about 1.4 and a depth Froude number of about 0.8 without passing through a range of depth Froude numbers near unity. The velocity, $V_2$, is expressed as follows:

$$V_2=Fn_d(gd_2)^{0.5}$$

$$V_2=0.8(gd_2)^{0.5} \quad (4)$$

Where:

$V_2$=initial vessel velocity within the transition area (meters/sec)

g=gravitational acceleration (meters/sec$^2$)

$d_2$=water depth within the transition area (meters)

Because the vessel velocities $V_1$ and $V_2$ are equal, equations (2), (3) and (4) can be combined to solve for $d_2$ as follows:

$$V_1=V_2$$

$$1.4(gd_1)^{0.5}=0.8(gd_2)^{0.5}$$

$$d_2 = d_1\left(\frac{1.4}{0.8}\right)^2 \quad (5)$$

The water depth within the transition area 10, $d_2$, is therefore calculated to be the product of the natural water depth, $d_1$, and the quotient of 1.4 and 0.8 squared. In turn, the height dimensions of the side walls 26, 28 and end walls 22, 24 of transition area 10 are equal to the difference between the water depth $d_2$ within the transition area 10, and the natural water depth, $d_1$. See also FIG. 1A.

In the course of movement through the transition area 10, the speed of the vessel 30 must be reduced to maintain a subcritical velocity, $V_3$, which produces a depth Froude number of about 0.8 when the vessel 30 operates outside of the transition area 10. The velocity, $V_3$, is given as follows:

$$V_3=Fn_d(gd_3)^{0.5}$$

$$V_3=0.8(gd_3)^{0.5} \quad (6)$$

Where:

$V_3$=subcritical vessel velocity outside of the transition area 10 (meters/sec)

g=gravitational acceleration (meters/sec$^2$)

$d_3$=natural water depth (meters)

In most applications, the natural water depths $d_1$ and $d_3$ are equal. Accordingly, the vessel 30 is operated to reduce its speed in the course of movement through the transition area 10 from an initial supercritical speed $V_1$, which produces a depth Froude number of about 1.4 outside of the transition area 10 and over a natural water depth $d_1$, to a subcritical speed $V_3$ which produces a depth Froude number of about 0.8 outside of the transition area 10 and over a natural water depth $d_3$. The vessel 30 is operated in the reverse manner when it is accelerated through the transition area 10, and thus transitions from subcritical to supercritical speed.

Figure 2A:
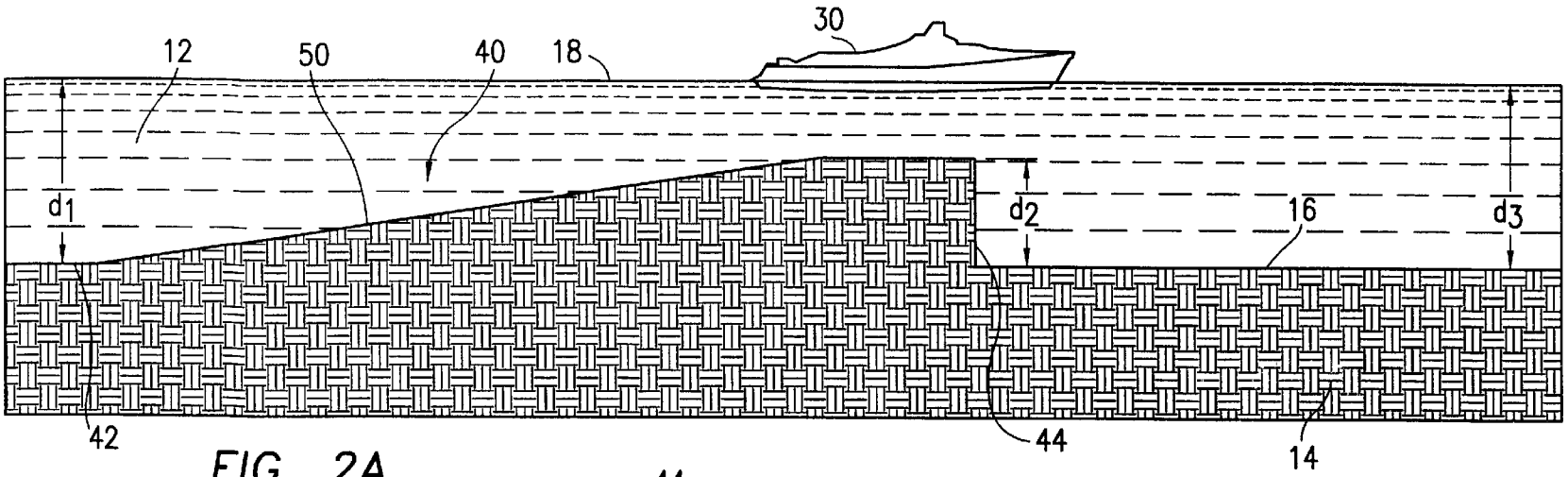
FIG. 2A is an elevational view, in partial cross section, of an alternative embodiment of the transition area of this invention.
Figure 2B:
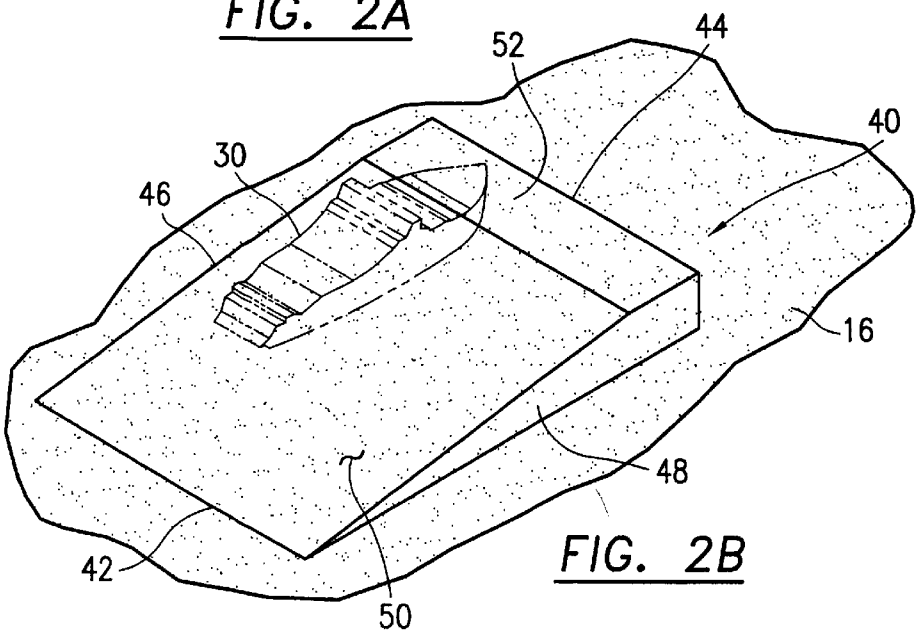
FIG. 2B is a perspective view of the transition area depicted in FIG. 2A.
Figure 2C:
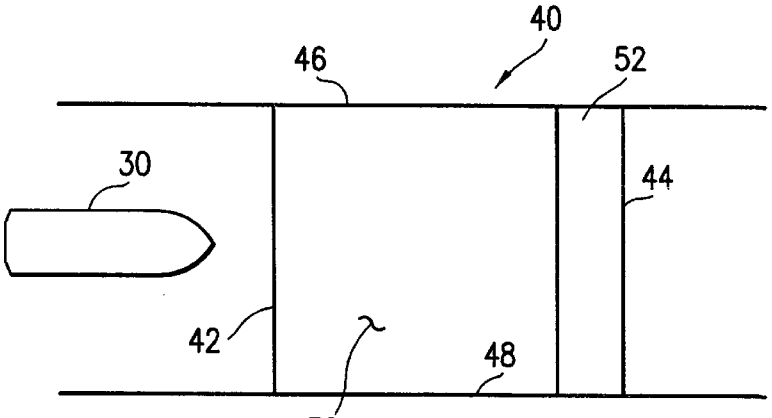
FIG. 2C is a schematic, plan view of the transition area shown in FIGS. 2A and 2B.

Referring now to FIGS. 2A–2C, an alternative embodiment of a transition area 40 is schematically depicted. The transition area 40 is formed in the shape of a ramp along the bed 14 of the body of water 12, and comprises a first end 42, a second end 44 spaced from the first end 42, opposed side walls 46 and 48, and, a top wall 50 which overlies the first and second ends 42,44 and the side walls 46,48. The first end 42 of transition area 40 is essentially flush with the top 16 of the bed 14, whereas the second end 44 extends substantially vertically upwardly from the bed 14 to a height, $d_2$, discussed in more detail below. The overall length of transition area 40, equal to the distance between the first and second ends 42, 44, is preferably about two to five lengths of the vessel 30. The distance between the side walls 46, 48 of transition area 40 is preferably equal to about one to five times the width of the vessel 30 which is submerged in the water. The side walls 46,48 and the top wall 50 are oriented at a substantially uniform angle between the first and second ends 42,44, which is preferably equal to the tangent of $d_2$ divided by the length of the transition area or ramp 40, i.e., about two to five vessel lengths. Additionally, a portion of the top wall 50 is preferably flattened or made generally parallel to the bed surface 16, as at 52, to facilitate construction of the transition area 40.

In FIGS. 2A–2C, the transition area 40 is shown as being formed of the same material as the bed 14 of the body of water 12. It is contemplated that soil, rock and other material from the bed 14 will be dredged from other areas of the body of water 12, or transported from sources on land, to form the transition area 40. Additionally, wall supports for the second end 44 and the opposed side walls 46,48 can be employed, such as steel beams, wood piles and the like, to maintain the integrity of the transition area 40.

The vessel 30 is operated somewhat differently over the transition area 40, compared to transition area 10, but the objective is the same, i.e., to obtain a substantially instantaneous transition between a depth Froude number of about 1.4 and a depth Froude number of about 0.8 as a result of passage over the transition area 40. Before entering the transition area 40, the vessel speed, $V_1$, is supercritical and preferably produces a depth Froude number of about 1.4. As such, the velocity $V_1$ is given by the Equation (2) noted above.

In the course of passage over the transition area 40, the speed of the vessel, $V_2$, must be reduced so that the depth Froude number at the top or second end 44 of transition area 40 is about 1.4 in water having a depth $d_1$–$d_2$, and then instantaneously changes to a depth Froude number of about 0.8 in water having a depth of $d_3$. This can be expressed in equation form as follows:

$$V_2 Fn_d[g(d_1-d_2)]^{0.5}$$

$$V_2=1.4[g(d_1-d_2)]^{0.5} \quad (7)$$

Where:

$V_2$=vessel velocity at the second end 44 of the transition area 40 (meters/sec)

g=gravitational acceleration (meters/sec$^2$)

$d_1$=natural water depth (meters)

$d_2$=height of the second end 44 of transition area 40 (meters)

In particular, the vessel velocity $V_2$ should be obtained by the time the vessel 30 reaches the "step" or second end 44 of transition area 40. Immediately after the step or second end 44 of the transition area 40, the vessel speed, $V_3$, is given by the following relationship:

$$V_3=0.8(gd_3)^{0.5} \quad (8)$$

Where:

$V_3$=velocity immediately after the second end 44 of transition area 40 within the water depth $d_3$ (meters/sec)

g=gravitational acceleration (meters/sec$^2$)

$d_3$=natural water depth immediately adjacent the second end 44 of transition area 40 (meters)

The velocity $V_3$ produces a depth Froude number of about 0.8, given the water depth $d_3$.

As noted above in connection with a discussion of the operation of vessel 30 over transition area 10, the velocity $V_1$ of vessel 30 approaching the transition area 10 and initially entering the transition area, $V_2$, are equal even though the depth Froude number changes from about 1.4 to about 0.8. This is due to a change in water depth from $d_1$ to $d_2$. In the embodiment of FIGS. 2A–2C, the vessel decelerates from a velocity $V_1$ to a velocity $V_2$ while passing over the transition area 40, but maintains substantially constant velocity while exiting the transition area 40 and passing over the second end 44 of the ramp. As such, the velocity $V_2$ of vessel 30 over the second end 44 of transition area 40 is equal to the velocity $V_3$ immediately past or outside of the transition area 40. Combining equations (7) and (8) yields the following:

$$V_2=V_3$$

$$Fn_d[g(d_1-d_2)]^{0.5}=Fn_d(gd_3)^{0.5}$$

$$1.4[g(d_1-d_2]^{0.5}=0.8(gd_3)^{0.5} \quad (9)$$

Where:

$V_2$=initial vessel velocity within the transition area 10 (meters/sec)

$V_3$=velocity immediately after the second end 44 of transition area 40 within the water depth $d_3$ (meters/sec)

g=gravitational acceleration (meters/sec$^2$)

$d_1$=natural water depth (meters)

$d_2$=height of the second end 44 of transition area 40 (meters)

$d_3$=natural water depth immediately adjacent the second end 44 of transition area 40 (meters)

Although the velocities $V_2$ and $V_3$ are equal, the depth Froude number changes from about 1.4 to about 0.8, respectively, due to the change in water depth from $d_1$–$d_2$ to a water depth of $d_3$.

In order to calculate the height of the second end 44 of transition area 40, $d_2$, which produces a water depth of $d_1$–$d_2$, equation (9) can be rewritten as follows:

$$d_2 = d_1\left[1-\left(\frac{0.8}{1.4}\right)^2\right] \quad (10)$$

Where:

$d_1$=natural water depth (meters)

$d_2$=height of the second end 44 of transition area 40 (meters)

Consequently, for a given natural water depth of $d_1$ on one end of transition area 40 and $d_3$ on the other end, the height (or depth) of the ramp forming the second end 44 of transition area 40 must be $d_2$ in order to produce a water depth of $d_1$–$d_2$, and, hence, a velocity $V_2$ over the second end 44 of transition area 40.

The foregoing discussion of transition area 40, and operation of vessel 30, assume movement of the vessel 30 in a left-to-right direction over transition area 30 and deceleration of the vessel from supercritical, deep water speeds into shallow waters. The vessel 30 is operated in the reverse manner of that described above in the course of leaving shallow waters and accelerating to deep water speeds.

Figure 3A:
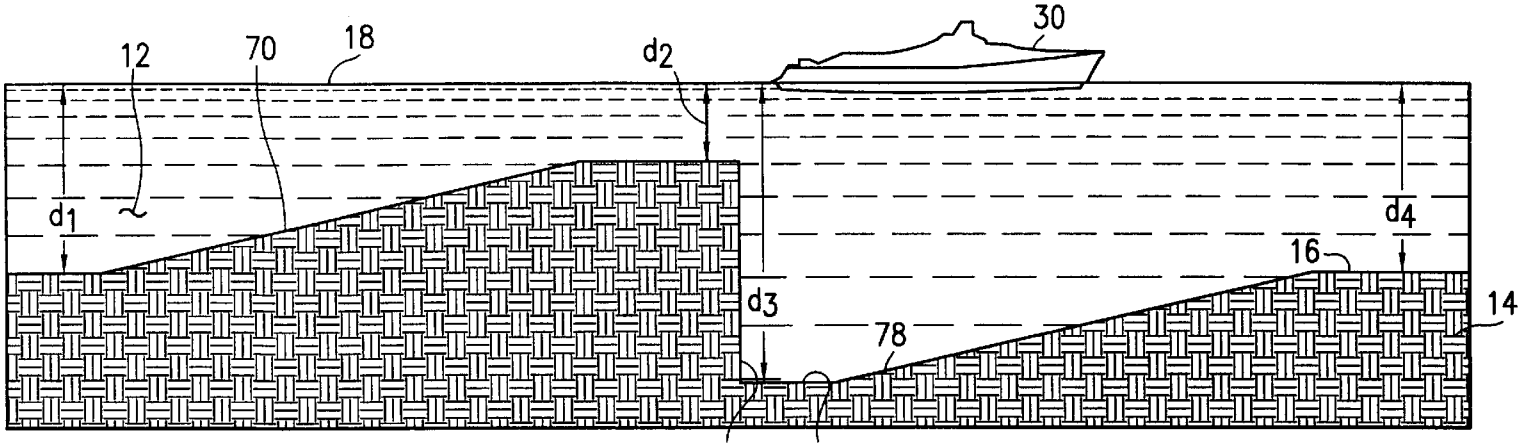
FIG. 3A is an elevational view, in partial cross section, of a further embodiment of the transition area herein.
Figure 3B:
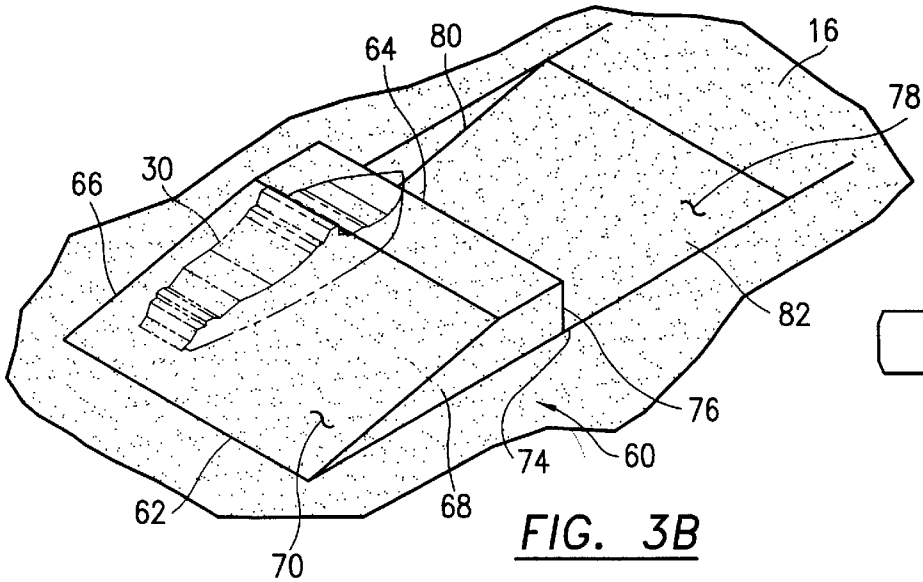
FIG. 3B is a perspective view of the transition area of FIG. 3A.
Figure 3C:
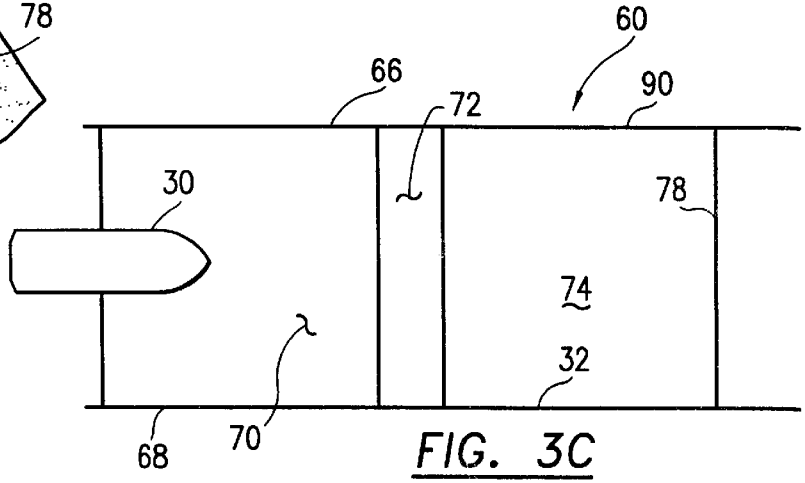
FIG. 3C is a schematic, plan view of the transition area shown in FIGS. 3A and 3B.

Referring now to FIGS. 3A–3C, a further embodiment of this invention is depicted in which a transition area 60 comprises essentially a combination of the dredged pit of FIGS. 1A–1C and the ramp of FIGS. 2A–2C. In the position of transition area 60 illustrated in the FIGURES, the vessel decelerates in moving from left to right over the transition area 60, and accelerates in the opposite direction.

The ramp portion and dredged pit portion of the transition area 60 are formed in a similar manner as their counterparts in the embodiments discussed above. The ramp portion is formed with a first end 62, and second end 64 spaced from the first end 62, opposed side walls 66 and 68, and, a top wall 70 which overlies the first and second ends 62, 64 and the side walls 66, 68. The first end 62 of the ramp portion of transition area 60 is substantially flush with the top 16 of the bed 14. Unlike the transition area 40 described in FIGS. 2A–2C, the height or depth of the second end 64 of transition area 60 can be freely chosen, except that the water depth, $d_2$, at the flattened uppermost portion 72 of top wall 70 should be sufficient to allow the keel of vessel 30 to readily clear the top wall 70.

The dredged pit portion of the transition area 60 comprises a bottom wall 74, opposed end walls 76 and 78, and, opposed side walls 80 and 82. Instead of having the shape of a rectangle or square, as in the transition area 10 of FIGS. 1A–1C, the dredged pit of transition area 60 has a vertically extending end wall 76 which is coincident with the second end 64 of the ramp portion, and an end wall 78 which extends upwardly at an angle from the bottom wall 74. As a result, the side walls 80, 82 are also angled upwardly from the bottom wall 74 and terminate at the level of the top of bed 14 of the body of water 12. Preferably, the overall length of transition area 60, measured from the first end 62 to the juncture of end wall 78 and the bed 14, is in the range of about two to five lengths of the vessel 30. The overall width of the transition area 60, measured by the distance between the side walls 66, 68 of the ramp portion and the side walls 80, 82 of the dredged pit portion, is equal to about one to five times that portion of the width of the vessel 30 which is submerged in the water.

The same instantaneous jump or transition between depth Froude numbers of about 1.4 and about 0.8 described above in connection with transition areas 10 and 40, is equally applicable to the transition area 60. Additionally, relationships similar to those given above apply to this embodiment of the invention as to the velocity $V_1$ of the vessel 30 approaching the transition area 60 before deceleration, the velocity $V_2$ of the vessel 30 as it passes over the second end 64 of the ramp portion of transition area 60, the velocity $V_3$ immediately past the second-end 64, and the velocity $V_4$ upon leaving the transition area 60. In particular, the velocity $V_1$ immediately before passing over the transition area 60 from left to right as depicted in FIG. 3A is given by the relationship in equation (2). Unlike the embodiment of FIGS. 2A–2C, the height or uppermost area 72 of the ramp portion of transition area 60 may be freely chosen. Preferably, such height should be at least sufficient to produce a water depth $d_2$ which allows the keel of vessel 30 to readily clear the uppermost area 72. The velocity $V_2$ of the vessel 30 over the second end 64 of the ramp portion is given by the same equation (7) noted above, but the variable $d_2$ is different:

$$V_2=Fn_d[g(d_1-d_2)]^{0.5}$$

$$V_2=1.4[g(d_1-d_2)]^{0.5} \quad (11)$$

Where:

$V_2$=vessel velocity at the second end 44 of the transition area 40 (meters/sec)

g=gravitational acceleration (meters/sec$^2$)

$d_1$=natural water depth (meters)

$d_2$=water depth over uppermost area 72 at the second end 64 of the ramp portion From an analysis of the dredged pit embodiment of transition area 10 depicted in FIGS. 1A–1C, it was determined that the height or depth of the bottom wall of the dredged pit relates to the water depth immediately adjacent to the "step" or increase in depth created by the dredged pit. This relationship is given above in equation (5) as follows:

$$d_2 = d_1\left(\frac{1.4}{0.8}\right)^2$$

In the embodiment of FIGS. 1A–1C, the depth $d_1$ is the natural water depth and $d_2$ represents the depth of the water from the surface 18 of the body of water to the bottom wall 20 of transition area 10.

Applying this relationship to transition area 60, yields the following:

$$d_3 = d_2\left(\frac{1.4}{0.8}\right)^2 \quad (12)$$

Where:

$d_2$=water depth at the uppermost portion 72 of the transition area 60 (meters)

$d_3$=water depth from surface 18 to bottom wall 74 of transition area 60 (meters)

Accordingly, the depth $d_3$ of the bottom wall 74 of transition area 60 can be determined with reference to the water depth over the ramp portion of transition area 60, i.e., at the flattened or uppermost area 72, using equation (12) above.

Consistent with the discussions of both transition areas 10 and 30, the velocity of the vessel 30 outside of the transition area 60 is selected to produce a depth Froude number of about 0.8. As such, the velocity, $V_4$, of vessel 30 within water depth $d_4$ outside of transition area 60 is given by the following:

$$V_4=0.8(gd_4)^{0.5} \quad (13)$$

Where:

$V_4$=velocity of vessel 30 leaving the dredged pit portion of transition area 60 (meters/sec)

g=gravitational acceleration (meters/sec$^2$)

$d_4$=natural water depth adjacent the dredged pit portion of transition area 60 (meters)

Additionally, as noted above, the foregoing discussion assume movement of vessel 30 in a left-to-right direction depicted in FIGS. 3A–3C. The vessel 30 is operated in the opposite manner when accelerating to leave shallow waters.

The transition areas 10, 40 and 60 of this invention therefore provide a means of reducing the wake wash which is otherwise created in shallow waters by the operation of vessels at critical speed. In each of these embodiments, an instantaneous jump or transition is obtained from a depth Froude number of about 1.4 to a depth Froude number of about 0.8 upon deceleration of a vessel, and from a depth Froude number of about 0.8 to a depth Froude number of about 1.4 upon acceleration of such vessel. The critical speed, which produces a depth Froude number of about unity, is by-passed and therefore wake wash is substantially reduced.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but the invention will include all embodiments falling within the scope of the appended claims.

What is claimed is:

1. The method of reducing the level of wake wash produced by a vessel while passing through shallow water within a body of water having a bed and a natural water depth, comprising:

(a) forming a transition area along the bed of the body of water within which the natural water depth is altered;

(b) decelerating the vessel from supercritical speed to subcritical speed in the course of passage in a first direction through the transition area, and accelerating the vessel from subcritical speed to supercritical speed in the course of passage in the opposite, second direction through the transition area, while substantially avoiding the critical speed range of the vessel.

2. The method of claim 1 in which step (a) comprises forming a dredged pit in the bed of the body of water having a greater water depth than on either side of the dredged pit.

3. The method of claim 2 in which the step of forming a dredged pit in the bed of the body of water having a water depth $d_2$ according to the following:

$$d_2 = d_1\left(\frac{1.4}{0.8}\right)^2$$

Where:

$d_1$=natural water depth on either side of the dredged pit.

4. The method of claim 1 in which step (a) comprises forming a dredged pit in the bed of the body of water having a length measured in the direction of movement of the vessel which is equal to in the range of about two to five times the vessel length.

5. The method of claim 1 in which step (a) comprises forming a dredged pit in the bed of the body of water having a width measured in a direction perpendicular to the direction of movement of the vessel equal to in the range of about one to five times that portion of the width of the vessel which is submerged in the water.

6. The method of claim 1 in which step (b) comprises decelerating the vessel in the course of passage through the transition area so as to move from a depth Froude number of about 1.4 to a depth Froude number of about 0.8.

7. The method of claim 1 in which step (b) comprises accelerating the vessel in the course of passage through the transition area so as to move from a depth Froude number of about 0.8 to a depth Froude number of about 1.4.

8. The method of claim 1 in which step (a) comprises forming a ramp along the bed of the body of water in which the water depth is decreased from one end of the ramp to the other end thereof.

9. The method of claim 1 in which step (a) comprises forming a ramp along the bed of the body of water in which the water depth is altered along the length of the ramp in the first direction of travel of the vessel from a natural water depth $d_1$ at the beginning of the ramp, to a lesser water depth $d_1$–$d_2$ where $d_2$ is the height at the end of the ramp measured from the bed of the body of water, and, then to a depth $d_3$ immediately past the end of the ramp which is substantially equal to the natural water depth $d_1$.

10. The method of claim 1 in which step (a) comprises forming a ramp along the bed of the body of water having a length measured in the first direction of movement of the vessel which is equal to in the range of about two to five times the vessel length.

11. The method of claim 1 in which step (a) comprises forming a ramp along the bed of the body of water having a width measured in a direction perpendicular to the first direction of movement of the vessel equal to in the range of about one to five times that portion of the width of the vessel which is submerged in the water.

12. The method of claim 1 in which step (a) comprises forming a ramp along the bed of the body of water and a dredged pit adjacent the ramp.

13. The method of claim 12 in which step (a) further comprises forming the ramp so that the water depth decreases from the natural water depth of the body of water at one end of the ramp to a shallowest water depth adjacent the dredged pit.

14. The method of claim 12 in which step (a) further comprises forming the dredged pit with a water depth greater than the natural water depth of the body of water.

15. The method of claim 14 in which step (a) further comprises forming the dredged pit with a bottom wall at which the water depth is maximum, and an angled end wall extending from the bottom wall so that the water depth decreases from the bottom wall to the natural water depth of the body of water.

16. The method of claim 12 in which step (a) further comprises forming the ramp and the dredged pit with a combined length measured in the first direction of movement of the vessel which is equal to in the range of about two to five times the vessel length.

17. The method of claim 12 in which step (a) further comprises forming the ramp and the dredged pit each with a width measured in a direction perpendicular to the first direction of movement of the vessel equal to in the range of about one to five times that portion of the width of the vessel which is submerged in the water.

18. The method of reducing the level of wake wash produced by a vessel while passing through shallow water within a body of water having a bed and a natural water depth comprising:

(a) forming a transition area along the bed of the body of water within which the natural water depth is altered;

(b) controlling the vessel speed in the course of passage through the transition area to substantially avoid a depth Froude number corresponding to the critical speed range of the vessel.

19. The method of claim 18 in which step (a) comprises a dredged pit in the bed of the body of water having a greater water depth than on either side of the dredged pit.

20. The method of claim 18 in which step (a) comprises forming a ramp along the bed of the body of water in which the water depth is decreased from one end of the ramp to the other end of the ramp.

21. The method of claim 18 in which step (a) comprises forming a ramp along the bed of the body of water in which the water depth is altered along the length of the ramp in one direction of travel of the vessel from a natural water depth $d_1$ at the beginning of the ramp, to a lesser water depth $d_1$–$d_2$ where $d_2$ is the height at the end of the ramp measured from the bed of the body of water, and, then to a depth $d_3$ immediately past the end of the ramp which is substantially equal to the natural water depth $d_1$.

22. The method of claim 18 in which step (a) comprises forming a ramp along the bed of the body of water and a dredged pit adjacent the ramp.

23. The method of claim 18 in which step (b) further comprises controlling deceleration of the vessel in the course of passage through the transition area so that the depth Froude number varies from about 1.4 to about 0.8.

24. The method of claim 18 in which step (b) further comprises controlling the acceleration of the vessel in the course of passage through the transition area so that the depth Froude number varies from about 0.8 to 1.4.

25. Apparatus for reducing the level of wake wash produced by a vessel, while passing through shallow water within a body of water having a bed and a natural water depth, said vessel having a length and a width, said apparatus comprising:

a transition area formed in the bed of the body of water, said transition area having a bottom wall, opposed end walls and opposed side walls collectively defining a dredged pit, the water depth within said dredged pit being greater than the natural water depth of the body of water;

said transition area having a length dimension defined by the distance between said opposed end walls, said length dimension being equal to in the range of about two to five times the length of the vessel; and said transition area having a width dimension defined by the distance between said opposed side walls, said width dimension being equal to in the range of about one to five times that portion of the width of the vessel which is submerged in the water.

26. The apparatus of claim 25 in which the water depth $d_2$ measured from said bottom wall of said transition area to the surface of the water is determined in accordance with the following relationship:

$$d_2 = d_1\left(\frac{1.4}{0.8}\right)^2$$

Where:

$d_1$=natural depth of body of water.

27. Apparatus for reducing the level of wake wash produced by a vessel in the course of passage through shallow water within a body of water having a bed and natural water depth, said vessel having a length and a width, said apparatus comprising:

a transition area formed along the bed of the body of water, said transition area including a ramp having a first end, a second end spaced from said first end, a top wall extending between said first and second ends, and opposed side walls located on either side of said top wall;

said ramp having a height dimension, measured from the bed of the body of water in an upward direction, which increases from said first end to said second end, the water depth at said second end of said ramp being greater than the natural water depth of the body of water;

said transition area having a length dimension defined by the distance between said first and second ends of said ramp, said length dimension being equal to in the range of about two to five times the length of the vessel; and said transition area having a width dimension defined by the distance between said opposed side walls, said width dimension being equal to in the range of about one to five times that portion of the width of the vessel which is submerged in the water.

28. The apparatus of claim 27 in which said top wall of said ramp extends at a substantially uniform angle between said first and second ends thereof.

29. The apparatus of claim 27 in which said first end of said ramp is substantially coincident with the bed of the body of water.

30. The apparatus of claim 27 in which said ramp has a height dimension, $d_2$, at said second end thereof which is determined in accordance with the following relationship:

$$d_2 = d_1\left[1 - \left(\frac{0.8}{1.4}\right)^2\right]$$

Where:

$d_1$=natural depth of body of water.

31. Apparatus for reducing the level of wake wash produced by a vessel in the course of passage through shallow water within a body of water having a bed and natural water depth, said vessel having a length and a width, said apparatus comprising:

a transition area formed in the bed of the body of water, said transition area including a ramp section adjacent to a dredged pit section;

said ramp section of said transition area comprising:

(i) a first end, a second end spaced from said first end, a top wall extending between said first and second ends, and opposed side walls located on either side of said top wall;

(ii) said ramp having a height dimension, measured from the bed of the body of water in an upward direction, which increases from said first end to said second end, the water depth at said second end of said ramp being greater than the natural water depth of the body of water;

(iii) said ramp having a length dimension defined by the distance between said first and second ends of said ramp, said length dimension being equal to the range of about two to five times the length of the vessel; and (iv) said ramp having a width dimension defined by the distance between said opposed side walls said width dimension being equal to in the range of about one to five times that portion of the width of the vessel which is submerged in the water;

said dredged pit section of said transition area comprising:

(i) a bottom wall, a first end wall coincident with said second end of said ramp section, a second end wall and opposed side walls;

(ii) the water depth measured from said bottom wall to the surface of the water being greater than the natural water depth of the body of water.

32. The apparatus of claim 31 in which said ramp section has a height dimension, $d_2$, at said second end thereof which is determined in accordance with the following relationship:

$$d_2 = d_1\left[1 - \left(\frac{0.8}{1.4}\right)^2\right]$$

Where:

$d_1$=natural depth of body of water.

33. The apparatus of claim 31 in which said second end wall of said dredged pit section is formed at an angle extending upwardly from said bottom wall of said dredged pit to the bed of the body of water.

34. The method of reducing the level of wake wash produced by a vessel while moving through shallow water within a body of water having a bed, a natural water depth and a transition area along the bed within which the natural water depth is altered, comprising:

(a) decelerating the vessel from supercritical speed to subcritical speed in the course of passage in a first direction through the transition area, while substantially avoiding the critical speed range of the vessel;

(b) accelerating the vessel from subcritical speed to supercritical speed in the course of passage in the opposite, second direction through the transition area, while substantially avoiding the critical speed range of the vessel.

35. The method of reducing the level of wake wash produced by a vessel while moving through shallow water within a body of water having a bed, a natural water depth and a transition area along the bed within which the natural water depth is altered, comprising:

(a) controlling the vessel speed in the course of passage through the transition area in a first direction to avoid a depth Froude number corresponding to the critical speed range of the vessel; and (b) controlling the vessel speed in the course of passage through the transition area in the opposite, second direction to avoid a depth Froude number corresponding to the critical speed range of the vessel.

* * * * *